US005635143A

United States Patent [19]

White et al.

[11] Patent Number: 5,635,143

[45] Date of Patent: Jun. 3, 1997

[54] MOBILE SYSTEM FOR MICROWAVE REMOVAL OF CONCRETE SURFACES

[75] Inventors: Terry L. White, Oak Ridge; Timothy S. Bigelow, Knoxville; Charles R. Schaich, Lenoir City; Don Foster, Jr., Knoxville, all of Tenn.

[73] Assignee: Martin Marietta Energy Systems, Inc., Oak Ridge, Tenn.

[21] Appl. No.: 316,020

[22] Filed: Sep. 30, 1994

[51] Int. Cl.[6] ..... H05B 6/64

[52] U.S. Cl. ..... 422/186.05; 422/900; 588/900; 219/690; 219/201; 219/221

[58] Field of Search ..... 422/186.05, 900; 588/900; 219/201, 221, 690

[56] References Cited

U.S. PATENT DOCUMENTS

| | | | |
|---|---|---|---|
| 3,430,021 | 2/1969 | Watson | 219/10.55 |
| 3,443,051 | 5/1969 | Püschner | 219/10.55 |
| 3,601,448 | 8/1971 | Stone | 299/14 |
| 3,614,163 | 10/1971 | Anderson | 299/14 |
| 4,061,480 | 12/1977 | Frye et al. | 53/356 |
| 4,221,680 | 9/1980 | Hardwick et al. | 252/301.1 |
| 4,319,856 | 3/1982 | Jeppson | 404/79 |
| 4,711,600 | 12/1987 | Yates | 404/95 |
| 5,003,144 | 3/1991 | Lindroth et al. | 219/10.55 A |
| 5,008,044 | 4/1991 | Hanulik | 252/628 |
| 5,481,092 | 1/1996 | Westmeyer | 219/679 |

FOREIGN PATENT DOCUMENTS 3002595 3/1991 Japan .

OTHER PUBLICATIONS

S. Ramo, J. R. Whinnery and T. Van Duzer, "*Fields and Waves in Communication Electronics*," John Wiley, New York, pp. 363–364, 1967.

H. Yasunaka et al, "Microwave Decontaminator for Concrete Surface Decontamination in JPDR," *Proc. Int. Decommissioning Symp.*, Oct. 4–8, pp. 109–115 (1987).

D. L. Hills, "The Removal of Concrete Layers from Biological Shields by Microwaves," Eur 12185EN, Commission of the European Communities, Brussels (1989).

*Primary Examiner*—Charles T. Jordan
*Assistant Examiner*—Daniel Jenkins
*Attorney, Agent, or Firm*—James M. Spicer; Joseph A. Marasco

[57] ABSTRACT

A method and apparatus for the microwave removal of contaminated concrete surfaces. The apparatus comprises a housing adapted to pass over a support surface. The housing includes a waveguide for directing microwave energy to the surface at an angle maximizing absorption of microwave energy by the surface. The apparatus is further provided with a source of microwave energy operably associated with the waveguide, wherein the microwave energy has a frequency of between about 10.6 GHz and about 24 GHz and acts to remove the uppermost layer from the surface. The apparatus further includes a debris containment assembly comprising a vacuum assembly operably associated with the housing. The vacuum assembly is adapted to remove debris from the area adjacent the surface.

23 Claims, 6 Drawing Sheets

MOBILE SYSTEM FOR MICROWAVE REMOVAL OF CONCRETE SURFACES

This invention was made with Government support under contract DE-AC05-840R21400 awarded by the U.S. Department of Energy to Martin Marietta Energy Systems, Inc. and the Government has certain rights in the invention.

FIELD OF THE INVENTION

The present invention relates to the removal of debris from concrete surfaces. More particularly, the present invention relates to an apparatus and method for the removal of radioactive contamination from concrete surfaces through the use of microwave energy.

BACKGROUND OF THE INVENTION

Residual radioactive contamination of concrete structures exists at nearly every nuclear processing plant. Additionally, residual radioactive contamination exists at nearly every laboratory and research center involved with the use of radioactive materials. Normally, however, only the surface layers of concrete are contaminated with residual radioactive material. Consequently, only the surface layers of concrete require treatment. This radioactive contamination presents a great health threat and must be removed in an inexpensive and expeditious manner.

Present mechanical techniques for removing contaminated concrete surfaces, while fast, have a number of shortcomings. For example, impact breaking machines have been used to remove the surface layers of contaminated concrete. However, these breaking machines generate large amounts of dust which necessitates elaborate abatement measures. As a result, impact breaking machines must be used on wet floors to suppress dust generation. This, however, can force soluble contamination deep into the fresh cracks made in the concrete by the impact breaking machines. Additionally, the impact of the mechanical chisels used in conjunction with impact breaking techniques drives contamination deeper into the concrete. Consequently, impact breaking techniques result in limited removal of residual radioactive contamination.

Further, the high pressure water sprayers used in conjunction with the mechanical chisels produce huge volumes of secondary contaminated waste water, and a method must be provided for recycling the contaminated waste water. This is illustrative of the difficulties associated with removing soluble contamination (that is, the residual radioactive material) using wet techniques.

Steel shot blasters are another mechanical method by which contaminated concrete is currently removed. The steel shot blasters use high-velocity steel shot to remove surface contamination. However, this method produces a high proportion of dust, which carries the contamination from the treatment area. As a result, steel shot blasters must be used in conjunction with wet surfaces, the problems of which have been discussed above. Further, steel shot blasters are slow when compared to other removal techniques.

Groups in Japan and the United Kingdom (UK) have investigated the feasibility of using microwaves to remove contaminated concrete layers. The top layers of concrete are dislodged by the application of microwave energy. Specifically, the microwaves heat the water that is chemically bound within the concrete. The resulting steam pressure causes the top layer of concrete to break apart. The concrete particles are small enough that they can be readily vacuumed away. After the top layers of the concrete are removed, the upper surface can be refinished so that it presents a smooth top surface.

In 1987, a group from the Japan Atomic Energy Research Institute (JAERI) reported on a mobile microwave decontaminator the was able to remove as much as a 3 cm layer of concrete in a single pass. Their technique provided a continuous removal rate of 11.1 $cm^3/s$ with 15 kW of microwave power at a frequency of 2.45 GHz. This removal rate is equal to that of the fastest commercial mechanical concrete breaking machines. Their work was published in the Proceedings of the International Decommissioning Symposium held in Pittsburgh, Pa. on Oct. 4–8, 1987 at pages IV-109 through IV-116.

Additionally, a group from the Harwell Laboratory in the UK reported on a fixed microwave demolition experiment that could remove a 10 cm layer in a single explosion. This group quoted a removal rate of 16 $cm^3/s$ by using 25 kW of microwave power at a frequency of 896 MHz.

The low frequencies utilized by the Japanese and UK groups, that is, 2.45 GHz and 896 MHz respectively, remove 3 and 10 cm of concrete surface, respectively, in a single pass. The extensive removal is due to the deeper penetration resulting from the use of lower frequency microwaves.

However, contamination generally only exists in the first 5 mm of concrete. The excess removal creates additional concrete debris that commingles with the contaminated material. The extra debris then becomes contaminated as a result of its contact with the contaminated material. This creates additional waste material that results in additional disposal costs.

Further, low frequency microwaves may be transmitted through the concrete surface as shown in FIG. 2. The transmitted power, or "shine-through", creates a hazardous biological heating effect. The transmitted power also creates a fire hazard when combustible materials on the floor below are heated by the transmitted microwaves. Our calculations indicate that a 4 in. thick concrete second floor could have as much as ⅓ the total power radiating down on the first floor. This transmitted power can reach several kW. If the amount of microwave leakage exceeds the ANSI standard of 5 $mW/cm^2$ for a 6 min. period, appropriate measures must be taken to ameliorate the resulting exposure.

The Japanese and UK groups utilized "box horn" designs that launch the microwave energy normal to the surface being acted upon. The "horns" are designed to maximize the power transferred to the concrete at a particular distance from the waveguide applicator. As a result, microwaves which contact metal objects are scattered directly back into the horn. These reflected microwaves can damage the microwave generator tubes.

After reviewing the prior art it is apparent that a need still exists for an efficient, inexpensive and reliable apparatus and method for removing radioactive contamination from concrete surfaces. The present invention provides such a method and apparatus.

BRIEF SUMMARY OF THE INVENTION

Therefore, it is an object of the present invention to provide an efficient, inexpensive, and reliable mobile apparatus for the removal of concrete surfaces.

An object of the present invention is also to provide a method and apparatus for removing shallow surface contamination from a concrete surface.

Another object of the present invention is to provide an apparatus and method for the removal of contamination from the first 5 mm of concrete in a single pass.

A further object of the present invention is to provide a method and apparatus which provides less microwave leakage due to microwave scattering.

An additional object of the present invention is to provide a method and apparatus which relies upon the principal of "Brewster's Angle" to optimize the microwave energy absorbed by the concrete surface.

These and other objects are accomplished by the present invention which provides a method and apparatus for the microwave removal of contaminated concrete surfaces. The apparatus comprises a housing adapted to pass over a surface. The housing includes a waveguide for directing microwave energy to the surface to maximize the absorption of the microwave energy by the surface in accordance with "Brewster's Angle". The apparatus is further provided with a source of microwave energy operably associated with the waveguide, wherein the microwave energy has a high frequency of between about 10.6 GHz and about 24 GHz, and acts to remove the uppermost layer from the concrete support surface. The apparatus further includes a debris containment assembly operably associated with the housing. The containment assembly includes a vacuum assembly adapted to remove debris from the area adjacent the concrete surface.

Other objects, advantages and salient features of the invention will become apparent from the following detailed description, which taken in conjunction with the annexed drawings, discloses the preferred embodiment of the present invention.

DETAILED DESCRIPTION OF THE PREFERRED EMBODIMENTS

Figure 1:
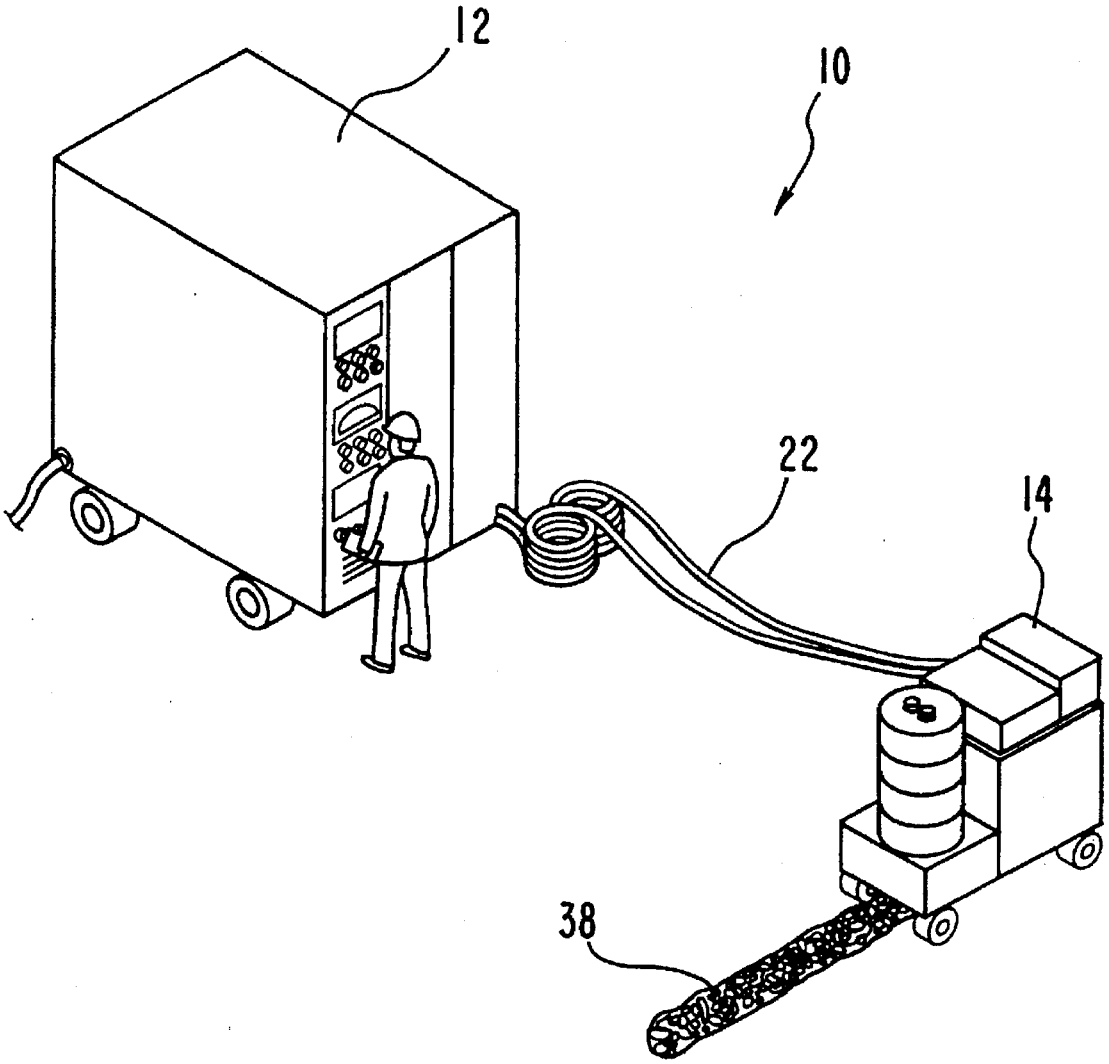
FIG. 1 is a perspective view of the present invention.

With reference to FIGS. 1, 3, 4 and 5, the overall apparatus 10 for the microwave removal of concrete surfaces 38 is shown. The apparatus 10 includes a large enclosure 12 containing a microwave high-voltage power supply, instrumentation and controls. Electrical power (480 V 3-phase, 130 A) and plant cooling water (76 L/min.) are supplied to the microwave power supply, instrumentation and controls. A fully mobile housing 14 which contains an applicator 16, a vacuum assembly 18, and a 55 gallon drum 20 for collecting concrete debris also forms a part of the present invention. Each of these features will be discussed in more detail below.

The mobile housing 14 is connected to the enclosure 12. The enclosure 12 supplies electrical power and cooling to the mobile housing 14 via lines 22. Additionally, the conventional microwave power supply contained in the large enclosure 12 controls the housing speed and the microwave power applied to the concrete 38 through the mobile housing 14.

Figure 3:
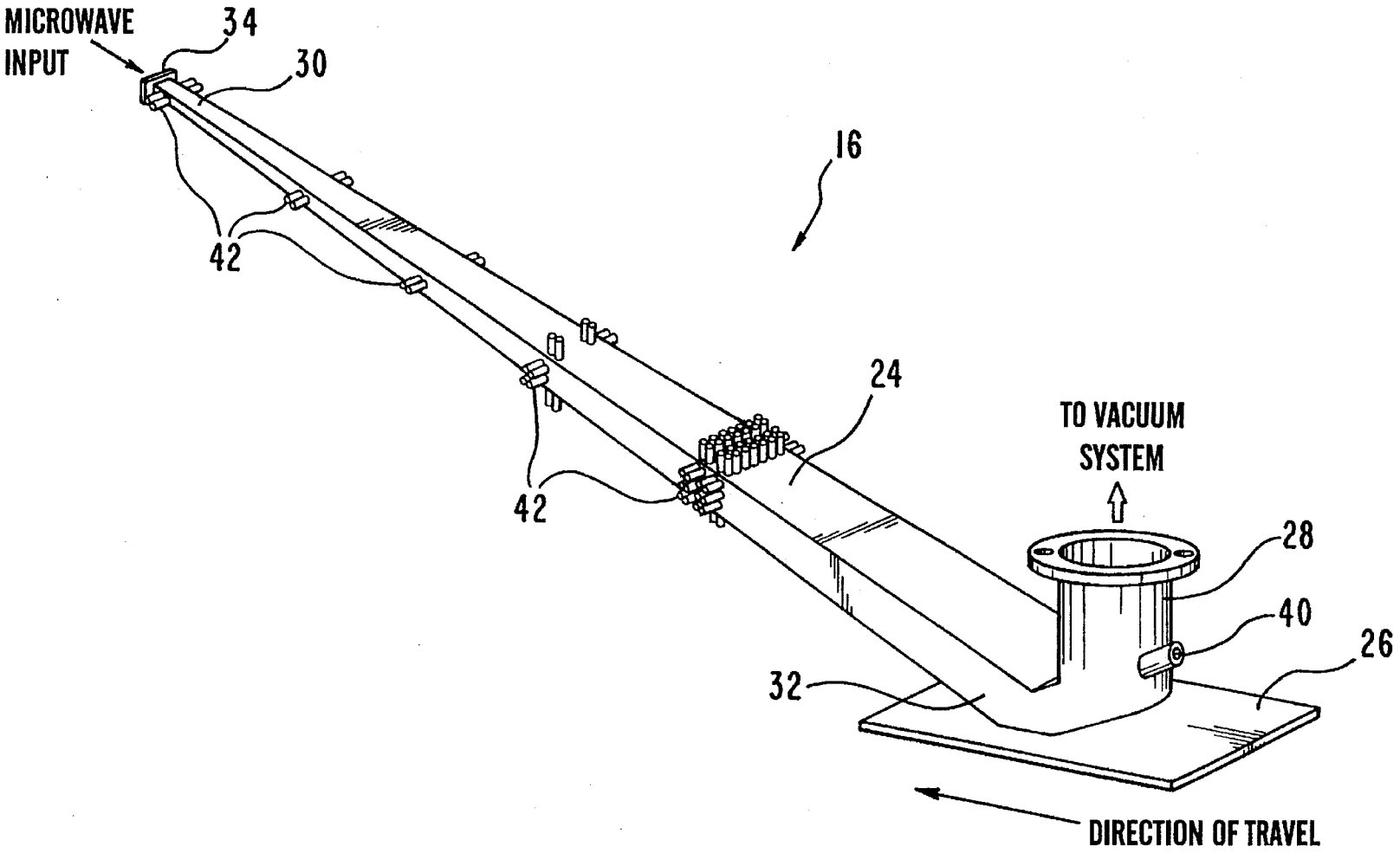
FIG. 3 is a perspective view of the applicator housed within the mobile housing.
Figure 4:
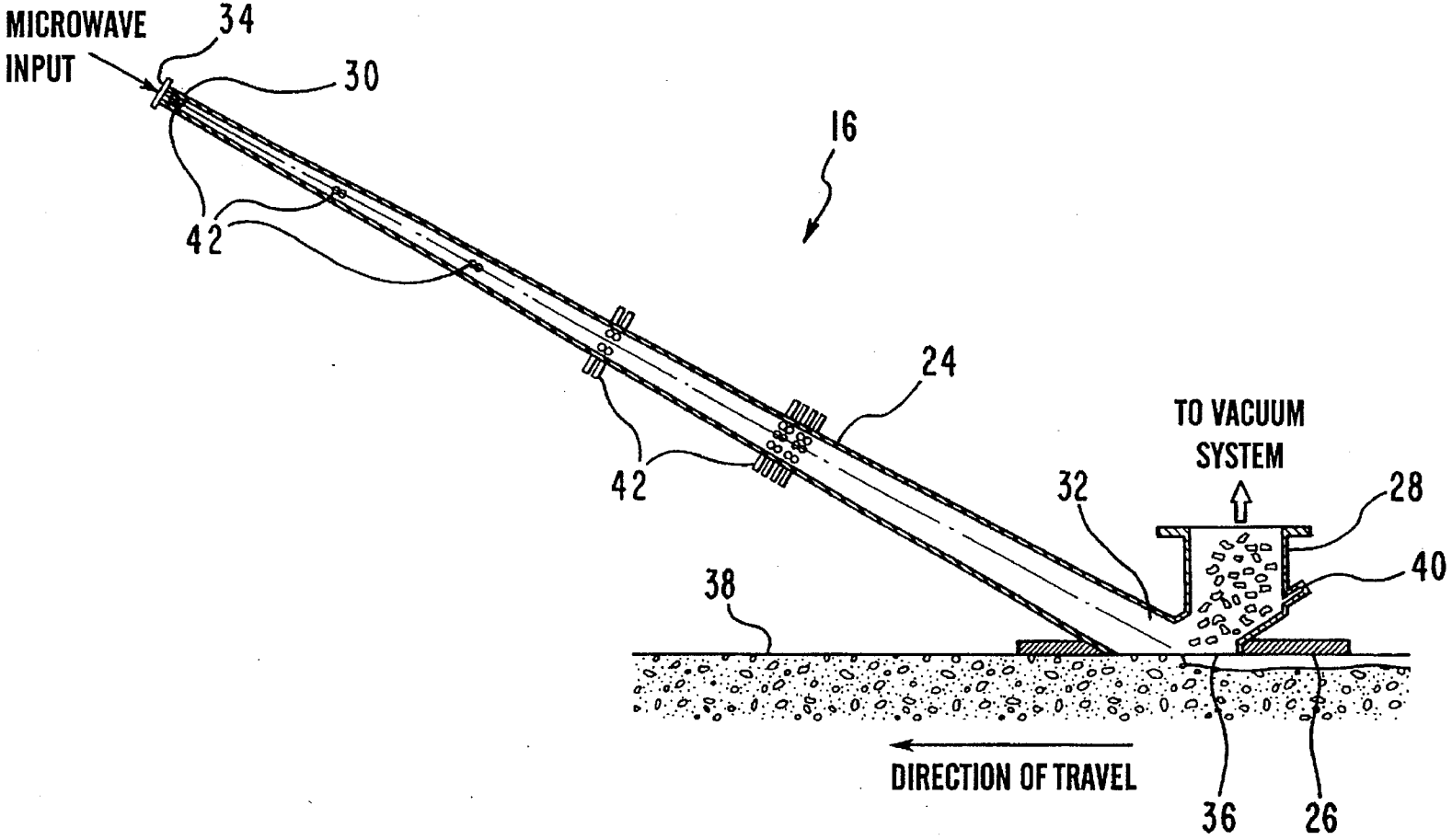
FIG. 4 is a cross-sectional view of the applicator housed within the mobile housing.
Figure 5:
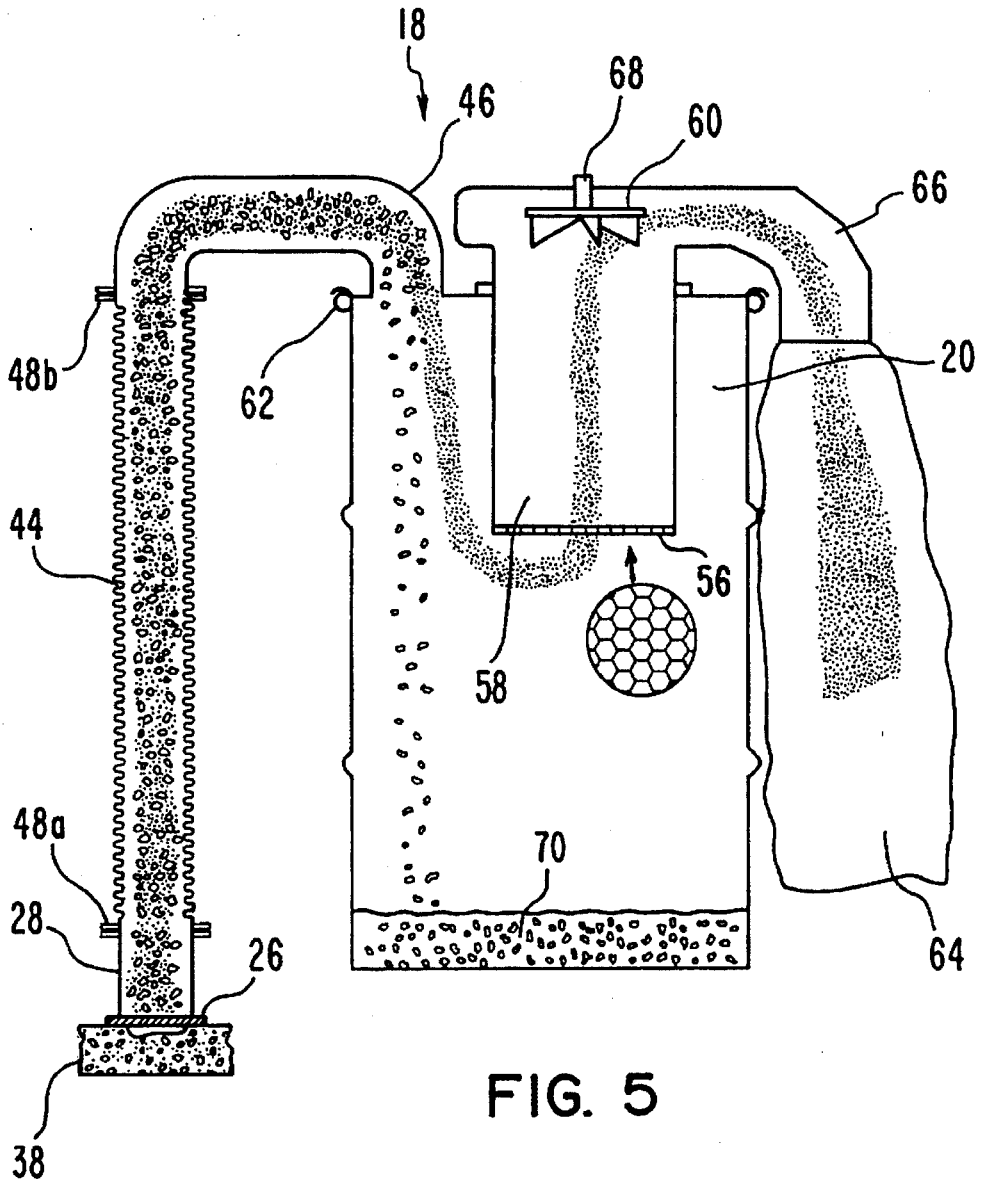
FIG. 5 is a schematic view of the vacuum assembly housed within the mobile housing.

The internal structure of the mobile housing 14 is shown in FIGS. 3, 4 and 5. Specifically, the applicator 16 and the vacuum assembly 18 are contained within the mobile housing 14. Referring to FIGS. 3 and 4, the applicator 16 includes a waveguide 24, a baseplate 26 and a concrete debris collection port 28.

The waveguide 24 is substantially rectangular in cross section and tapers outwardly as it extends from its proximal end 30 to its distal end 32, in other words, gradually increasing in cross-sectional area. However, the rectangular shape is merely the preferred embodiment of the present invention, and a variety of shapes could be utilized while remaining within the spirit of the present invention. Specifically, when high frequency microwaves are used the gradual taper of the waveguide 24 permits uniform exposure of the microwaves to a surface larger than the microwave input 34 of the waveguide 24, without detrimentally effecting the uniformity of the microwaves. However, the waveguide 24 should not be so long that the microwaves loose substantial energy by the time they reach the surface being treated.

The advantages associated with a gradually tapered waveguide 24 are only applicable when high frequency microwaves are utilized with the present invention. For example, if an individual chooses to use the mobile housing 14 with microwaves having a frequency of 2.45 GHz, the tapered waveguide 24 would not be necessary.

The microwave input 34 is located at the proximal end 30 of the waveguide 24. The microwave input 34 is secured to the microwave tube such that microwave energy is directed through the microwave input 34 to pass down the waveguide 24.

As the waveguide 24 extends from the microwave input 34, it tapers outwardly until it reaches the baseplate 26. At the point where the waveguide 24 and the baseplate 26 are secured together, they form an opening 36 which permits the microwave energy to contact the concrete surface 38 being acted upon.

The concrete debris collection port 28 is connected to the waveguide 24 and the baseplate 26 adjacent the opening 36. The concrete debris collection port 28 is in fluid communication with the waveguide 24 and the opening 36. This permits concrete debris produced by the action of the microwave energy to be removed from the area adjacent the opening 36. A video camera port 40 (video camera not shown) is formed in the concrete debris collection port 28 to permit a user to view the concrete surface 38 being acted upon by the microwave energy.

In the preferred embodiment of the present invention, the waveguide 24 is positioned at a 20° angle with respect to the flat baseplate 26. The baseplate 26 is flat and is designed to lie directly on the concrete surface 38 being treated. Consequently, the waveguide 24 should also be at a 20° angle with respect to the treated concrete surface 38 when the present invention is properly utilized. As a result of the 20° angle of the waveguide 24 to the baseplate 26, the microwave energy is applied to the concrete surface 38 at an angle of approximately 20°. Microwave energy propagating near this angle (approximately 20° from the horizontal floor) is absorbed by the concrete floor 38.

The waveguide's orientation efficiently applies almost 100% of the available microwave power into the concrete, while allowing for the attachment of the concrete debris collection port 28 in close proximity to the concrete explosions so that almost all concrete debris is collected. Since almost all of the microwave energy is absorbed by the concrete, very little microwave energy is transmitted into the vacuum assembly 18, and almost none passes through the concrete floor to the area beneath the floor. This is due to the longer path length produced in the concrete and due to the strong absorption of the microwaves at 18 GHz.

The angular orientation of the waveguide 24 is based upon the principal of "Brewster's Angle". The principle of "Brewster's Angle" defines the angle of incidence at which a wave will not be reflected from a dielectric surface. Since the dielectric constant of materials varies, Brewster's angle will vary depending upon the material the wave comes in contact with. Additionally, Brewster's Angle may also vary as a function of the frequency of the microwaves being applied to the surface or as a function of the cross-sectional size of the waveguide.

Although the preferred embodiment of the present invention is intended for the removal of contaminated concrete surfaces, and the angular orientation of the waveguide is designed with concrete in mind, the waveguide could be oriented differently depending upon the material being treated. For example, the present invention could be used to remove the uppermost layer of an asphalt surface. If this were done, based upon the dielectric constant of asphalt and Brewster's Angle, the waveguide would have an angular orientation of approximately 60°.

As discussed previously, the vacuum assembly 18 is tightly integrated into this high-powered microwave system. Inlet air is drawn through the waveguide 24 by locating arrays of ¼ inch diameter by 11/16 in. long tubes 42 along the length of the waveguide as shown in FIGS. 3 and 4. The diameter and length of the tubes 42 are designed to permit only a very small amount of the microwave energy to escape the waveguide 24 through the tubes 42. The arrays of tubes 42 are spaced by a $5/4^{ths}$ of a guide wavelength along the axis so that reflections from one axial location along the waveguide 24 are canceled by a group of tubes 42 at the next axial location along the waveguide 24. This scheme effectively allows a large throughput of air to be pulled through the waveguide 24 without any significant microwave leakage.

The high throughput of air permits the concrete debris to be vacuumed up into the collection drum 20 shown in FIG. 5. The vacuum assembly 18 is connected to the microwave opening 36 via the concrete debris collection port 28. The concrete debris collection port 28 is connected to the 55 gallon storage drum 20 by a bellows 44. The bellows 44 is attached to the concrete debris collection port 28 and the lid 46 of the drum 20 by respective microwave tight flange joints 48*a*, 48*b*.

Figure 6:
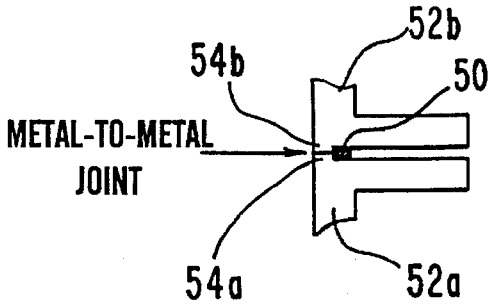
FIG. 6 is a cross-sectional view of the flange joint shown in FIG. 5.

Specifically, the flange joints 48*a*, 48*b* are designed to produce a metal-to-metal interference fit at the connection of the bellows 44 with the concrete debris collection port 28 and the drum lid 46 to contain the microwave energy and concrete debris. The details of the flange joints 48*a*, 48*b* are shown in FIG. 6. In FIG. 6, a thin alignment ring 50 serves to center the two flanges 52*a*, 52*b* along the same axis. An extending lip 54*a* on the inside diameter of the flange 52*a* is compressed against an identical lip 54*b* on the opposite flange 52*b* by a standard bolt pattern (not shown).

The collection drum 20 is provided with a microwave screen 56 covering the inlet 58 to the vacuum motor impeller 60. The screen 56 is preferably made from stainless steel and includes honeycomb shaped openings. The screen 56 is 90% open. In use, the screen 56 prevents the passage of microwaves into the vacuum motor 68 in the event that microwaves bounces off the concrete 38 and into the vacuum assembly 18. This could occur when the applicator 16 is moved over a metal plate or metal bolt anchor imbedded in the floor. A rubber drum lid seal 62 is coated with a silver paint to insure that all the microwave energy in the drum 20 is completely contained during operation of the apparatus 10. The removed concrete debris 70 in the drum 20 serves as a load absorbing microwave energy in the event that the applicator 16 passes over a large metal object in the concrete. This allows the microwave tube to continue operating without damaging reflections. Microwave energy scattered off of metal objects is forward scattered into the drum and not backward toward the microwave tube.

The vacuum assembly 18 is also provided with a dust collection bag 64. The dust collection bag 64 is secured to the outlet 66 of the vacuum motor 68, and prevents the escape of any contaminated materials that do not settle in the drum 20.

Figure 2:
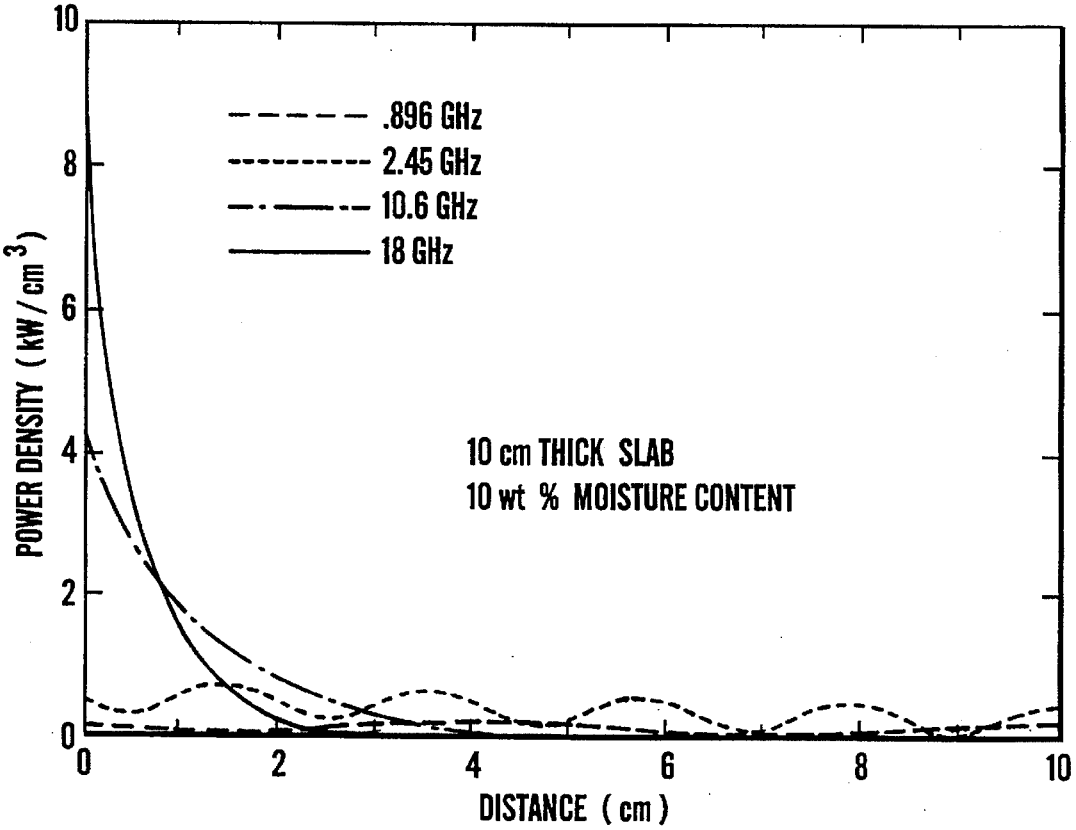
FIG. 2 is a graphical representation showing Microwave Power Density v. Distance in Concrete and Frequency for 4 kW of Net Power.

Preferably, the frequency of the microwave energy used in accordance with the present invention is approximately between about 10.6 GHz and about 24 GHz, which is currently the highest frequency used for scientific and industrial applications. However, scientific advances permitting higher frequencies could be used while remaining within the spirit of the invention. Additionally, lower frequencies may be used with the applicator discussed above while still remaining within the spirit of the invention. One embodiment has been designed to operate at 18 GHz at a power level of 15 kW. The high frequency removes surface contamination as shown in FIG. 2. The microwave power at this frequency is more strongly absorbed, thereby causing the wave amplitude to decay quickly into the surface, when compared to absorption at lower frequencies. This causes the uppermost 5 mm of concrete, where most of the radioactive surface contamination resides, to be removed very efficiently. This system is very effective and produces minimal amount of waste. Deeper contaminations can be removed by a using a longer residence time under the opening to create multiple explosions in the same area. Alternately, deeper contaminations can be removed by taking multiple passes over previously treated areas.

The high frequency microwaves used in accordance with the present invention are not as transparent to the concrete as lower frequency microwaves. The fact is illustrated in FIG. 2. Microwave energy transmitted through the concrete surface (that is, the transmitted power or "shine-through") results in hazardous biological heating. The transmitted microwave energy also creates a fire hazard when combustible materials on the floor below are heated by microwaves. Calculations indicate that a 4 in. thick concrete second floor could have as much as ⅓ the total power radiating down on the first floor. This power can reach several kW. If the amount of microwave leakage exceeds the ANSI standard of 5 $mW/cm^2$ for a 6 min. period, than appropriate measures must be taken to ameliorate this exposure. The present invention's use of microwave energy at a frequency of about 18 GHz is substantially absorbed by the concrete and does not present the risks associated with the use of lower frequency microwaves. Specifically, there is virtually no power transmitted through the floor and microwave leakage around the applicator is less than the ANSI standard.

The present invention has the ability to operate around metal objects at the surface of the concrete because there is always an object available to absorb the scattered microwaves. Specifically, the orientation of the waveguide 24 directs scattered microwaves forward into the drum 20 of the vacuum. The scattered microwaves are then completely absorbed by concrete debris 70 that has settled in the bottom of the drum.

The present invention provides a microwave removal apparatus and method which is lightweight, easily maneuverable, and easily adapted to utilize a robotic arm for cleaning walls. The present invention requires no impacting of the concrete surface, no excess water due to the low dust generation, and a limited number of moving parts.

Figure 7:
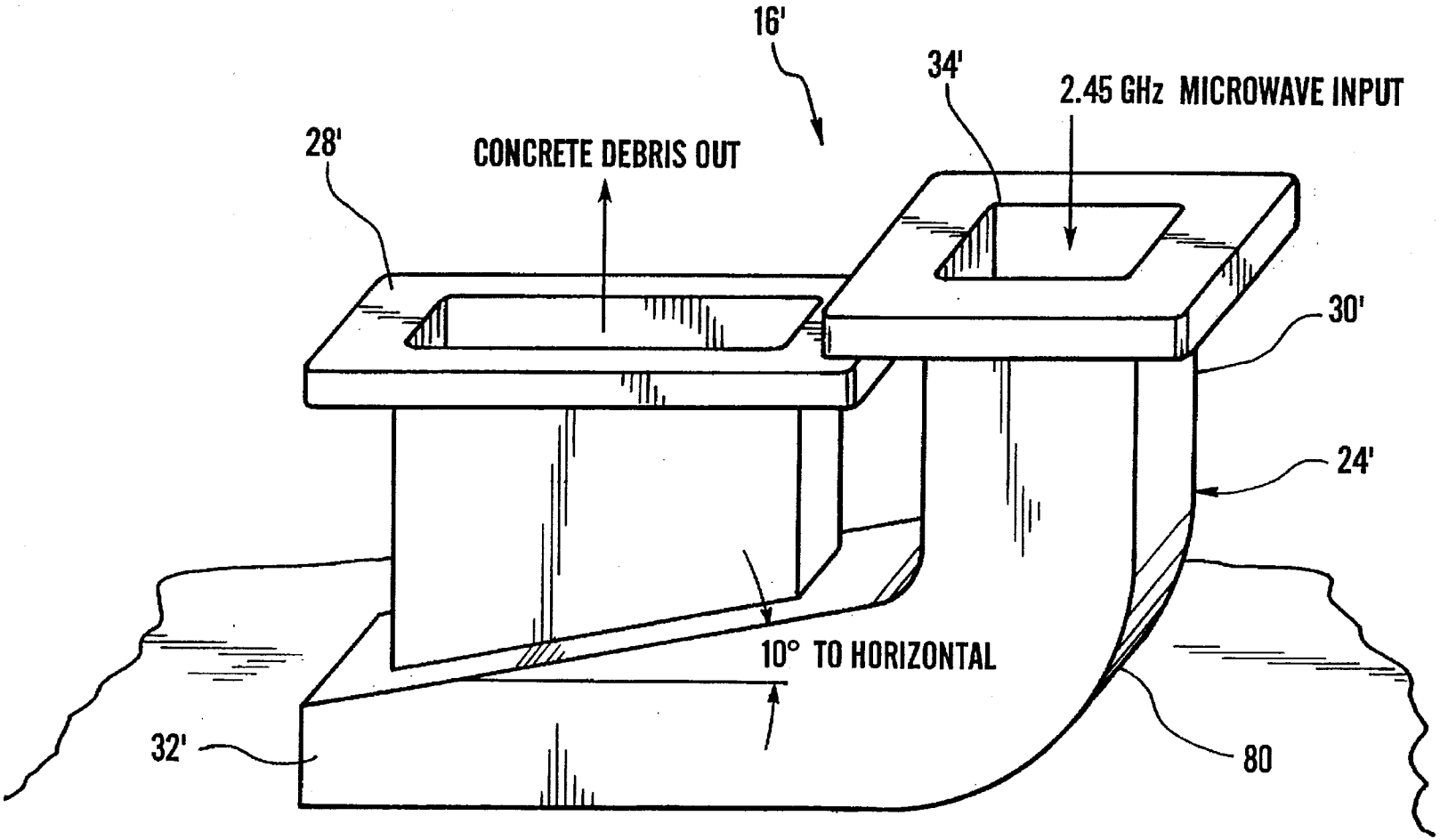
FIG. 7 is a perspective view of an alternate embodiment of the applicator.

An alternate embodiment of the applicator 16' is shown in FIG. 7. The alternate applicator 16' is intended for use with lower frequency microwaves, for example, 2.45 GHz. As discussed previously, lower frequency microwaves do not require a gradually tapering waveguide. Consequently, the alternate applicator 16' includes a waveguide 24' having a constant cross-sectional area as it extends from its proximal end 30' to its distal end 32'. In this embodiment, a microwave input 34' is located at the proximal end 30' of the waveguide 24' and initially directs microwaves normal to the concrete surface. However, to maximize the absorption of the microwave energy by the concrete surface, the waveguide 24' includes a curved central portion 80 which directs the microwave energy such that it contacts the concrete surface at Brewster's Angle. In the embodiment shown in FIG. 7, that angle is 10° based upon the cross-sectional area (4.3' by 2.1') of the waveguide 24' and the lower frequency of the microwave energy.

The applicator 16' further includes a concrete debris collection port 28' secured at the distal end 32' of the waveguide 24' adjacent the microwave opening (not shown). The collection port 28' has the same cross-sectional area as the waveguide 24', but is rotated 90° with respect to the waveguide 24'. The rotation prevents scattered microwaves from entering the vacuum assembly, thereby obviating the need for a protective screen. Although the arrays of air entrance tubes are not shown in FIG. 7, they may be included to facilitate the high throughput achieved by the embodiment of FIGS. 3 and 4.

In another alternate embodiment of the present invention, the mobile housing could be fitted with a robotic arm/waveguide combination so that walls and corners of rooms could be decontaminated. The robotic arm/waveguide could replace existing manipulators used in concrete-lined hot cells that require decontaminating. The arm would be lighter and less bulky that prior mechanical techniques. The microwave waveguide would be compatible with hot cell manipulator arm mountings. The arm would have rotating waveguide joints in the waveguide transmission system to achieve all the desired degrees of freedom required for such an application.

As stated previously, the present invention could also be used for the removal of asphalt surfaces. Additionally, the applicator can be used to apply high power microwave energy to dry, fracture, or melt, in a continuous mode, a wide range of materials such as radioactive incinerator ash, mined minerals, chemicals, plastics, ceramics and foods. However, care should be taken to adjust the angle at which the microwaves are applied in accordance with "Brewster's Angle".

While the preferred embodiment has been used to illustrate the present invention, it will be understood by those skilled in the art that various changes and modifications can be made therein without departing from the scope of the invention as defined in the appended claims.

We claim:

1. An apparatus for the microwave removal of surfaces, comprising:

a mobile housing capable of passing over a surface;

a waveguide coupled to said housing, said waveguide oriented at substantially Brewster's angle with respect to said surface;

a microwave energy source coupled to said waveguide for dislodging the uppermost layer from the surface, said microwave energy source outputting microwave energy at substantially the same angular orientation to said surface as said waveguide to maximize absorption of the microwave energy by the surface; and a containment assembly coupled to said waveguide for removing and storing the dislodged uppermost layer of the surface, said containment assembly including a microwave compatible surface debris Storage means; and a vacuum assembly in fluid communication with said waveguide, said vacuum assembly operable to draw the dislodged uppermost layer away from the surface and convey it to said storage means.

2. The apparatus according to claim 1, wherein said microwave energy has a frequency of at least about 10.6 GHz.

3. The apparatus according to claim 2, wherein said microwave energy has a frequency between about 10.6 GHz and 24 GHz.

4. The apparatus according to claim 3, wherein said microwave energy is supplied at a power level of 15 kW.

5. The apparatus according to claim 1, wherein said containment assembly includes an debris collection port communication with a storage drum and a vacuum motor, said storage drum being positioned between said debris collection port vacuum motor for the collection of surface debris drawn through said debris collection port, wherein scattered microwave energy is absorbed by surface debris collected in said drum, thereby prevent scattered microwave energy from escaping from said containment assembly.

6. The apparatus according to claim 1, wherein said waveguide is oriented at approximately a 20° with respect to said mobile housing.

7. The apparatus according to claim 1, wherein said waveguide has a proximal end and a distal end, and said waveguide gradually tapers outwardly as it extends from said proximal end to said distal end.

8. The apparatus according to claim 1, wherein said waveguide includes arrays permitting air to be drawn through said waveguide.

9. An applicator for directing microwave energy toward a surface, comprising:

a waveguide oriented at substantially Brewster's angle with respect to the surface for directing microwave energy at the surface to maximize absorption of the microwave energy by the surface;

said waveguide having a proximal end with a microwave input and a distal end with an opening permitting exposure of the surface to the microwave energy;

said waveguide further including arrays of air inlet tubes spaced and dimensioned so as to minimize the escape of microwave energy from said waveguide.

10. The applicator according to claim 9, wherein said waveguide gradually tapers outwardly as said waveguide extends from said proximal end to said distal end.

11. The applicator according to claim 10, wherein said waveguide has a rectangular cross section.

12. The applicator according to claim 9, wherein said waveguide has a rectangular cross section.

13. The applicator according to claim 9, further including a collection port in fluid communication with said waveguide and said opening for directing debris to a vacuum assembly.

14. The applicator according to claim 9, wherein said arrays of air inlet tubes are longitudinally spaced along said waveguide.

15. The applicator according to claim 9, further including a base plate secured to said distal end of said waveguide, said waveguide being at approximately a 20° angle with respect to said baseplate which is adapted to lie parallel to the surface.

16. The applicator according to claim 9, wherein said waveguide has a consistent cross-section size as it extends from its distal end to its proximal end.

17. The applicator according to claim 10, further including a collection port in fluid communication with said waveguide and said opening for directing debris to a vacuum assembly, said collection port having the same cross-sectional size as said waveguide and being rotated 90° with respect to said waveguide.

18. A containment assembly for use with a microwave waveguide for the removal and storage of surface debris dislodged from a surface through the use of microwave energy, comprising:

a debris collection port coupled to the waveguide, said port also in fluid communication with a storage drum and a vacuum motor, said storage drum positioned between said debris collection port and said vacuum motor for the collection of surface debris drawn through said debris collection port, and for the absorption of microwave energy scattered from the surface, wherein the scattered microwave energy from the surface is absorbed by surface debris collected in said drum, thereby preventing scattered microwave energy from escaping from said containment assembly.

19. The containment assembly according to claim 18, wherein said vacuum motor includes a motor inlet positioned within said drum, said motor inlet being covered by a screen preventing microwave energy from passing into the vacuum motor.

20. The containment assembly according to claim 19, wherein said screen is stainless steel.

21. The containment assembly according to claim 19, wherein said screen has honeycomb shaped openings.

22. The containment assembly according to claim 18, wherein said vacuum motor includes a motor outlet having a dust collection bag secured to said motor outlet to prevent the inadvertent escape of surface debris from said containment assembly.

23. The containment assembly according to claim 18, wherein said drum has a top and a bottom, and said vacuum motor and said inlet are coupled to said top of said drum so that surface debris are drawn into said drum and settle on said bottom of said drum.

* * * * *